US006254431B1

(12) United States Patent
Murakami et al.

(10) Patent No.: US 6,254,431 B1
(45) Date of Patent: Jul. 3, 2001

(54) WATERPROOF CONNECTOR

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/570,528

(22) Filed: May 12, 2000

(30) Foreign Application Priority Data

May 18, 1999 (JP) ..... 11-137408

(51) Int. Cl.[7] ..... H01R 13/53
(52) U.S. Cl. ..... 439/587; 439/595
(58) Field of Search ..... 439/190, 271, 439/274, 275, 587, 586, 588, 589, 597, 598

(56) References Cited

U.S. PATENT DOCUMENTS 4,895,533 * 1/1990 Yagi et al. ..... 439/587
5,571,032 * 11/1996 Sano et al. ..... 439/589

* cited by examiner

*Primary Examiner*—Brian Sircus
*Assistant Examiner*—Michael C. Zarroli
(74) *Attorney, Agent, or Firm*—Finnegan, Henderson, Farabow, Garrett & Dunner, L.L.P.

(57) ABSTRACT

A waterproof connector has an inner housing, an outer housing, and a rubber plug. The inner housing has a terminal accommodation chamber, a terminal that is accommodated within the terminal accommodation chamber being connected to an electric wire. The outer housing has an opening and a bottom wall. When the inner housing is inserted from the opening into the outer housing and the both are fitted together, the bottom wall opposes the terminal accommodation chamber. The outer housing has a hole that is formed in the bottom wall and that opens toward outside the outer housing, and a concavity portion that communicates the hole and the interior of the outer housing. The rubber plug has a main-body portion corresponding to the concavity portion, a cylindrical extended portion corresponding to the hole, and a through hole passing through the main-body portion and the extended portion. The main-body portion is inserted into the concavity portion while the extended portion is inserted into the hole. The through hole communicates the interior of the outer housing and the exterior of the same. The electric wire passes through the through hole and is then extended into the outer housing and connected to the terminal.

20 Claims, 4 Drawing Sheets

WATERPROOF CONNECTOR

BACKGROUND OF THE INVENTION

The present invention relates to a waterproof connector.

A conventional waterproof connector has an outer housing made of synthetic resin, an inner housing having terminal accommodation chambers, which is made of synthetic resin and which is fitted into the outer housing, and a spacer retaining terminals within the terminal accommodation chambers between the inner housing and the outer housing, which spacer is made of synthetic resin.

A wall of the outer housing has a concavity portion open to within the outer housing and a hole communicating a bottom of the concavity portion and the outside of the outer housing. In the concavity portion there is inserted a cylindrical rubber plug. An electric wire that has been connected to the terminal within the inner housing passes through the rubber plug and the hole and then is extended to outside the waterproof connector.

SUMMARY OF THE INVENTION

However, in the above-described waterproof connector, the electric wire directly contacts the inner surface of the hole of the outer housing made of hard synthetic resin. Therefore, there is the likelihood that the electric wire would be impaired due to the friction caused by vibrations and to the impact applied thereto. Also, there is the likelihood that water will enter into between the concavity portion of the outer housing and the rubber plug by way of and along the electric wire and will be frozen. In this case, it is likely that, because the water is in contact with the wall of the hard synthetic resin outer housing, the wall will be pressed by the volumetric expansion of the water when it becomes ice and be broken.

Thereupon, it is an object of the present invention to provide a waterproof connector capable of preventing impairment of the electric wire due to vibrations, etc. and impairment of the wall due to freezing of the water that has entered.

To achieve the above object, a waterproof connector according to a first aspect of the present invention has an inner housing, an outer housing, and a rubber plug. The inner housing has a terminal accommodation chamber, and a terminal accommodated within the terminal accommodation chamber is connected to the electric wire. The outer housing has an opening and a bottom wall. When the inner housing has been inserted through the opening into the outer housing and the both are fitted together, the bottom wall opposes the terminal accommodation chamber. The outer housing has a hole that is formed in the bottom wall and that opens toward outside the outer housing. The outer housing also has a concavity portion that communicates with the hole and with the interior of the outer housing. The rubber plug has a main-body portion configured to fit into the concavity portion, a cylindrical extended portion configured to fit into the hole, and a through hole passing through the interior of the main-body portion and that of the extended portion. The main-body portion is inserted into the concavity portion while the extended portion is inserted into the hole. The through hole provided communicates between the interior of the outer housing and the exterior of the same. The electric wire passes through the through hole and is then extended into the outer housing and connected to the terminal.

The extended portion of the plug may be extended outside the outer housing. The concavity portion may be a second hole that has been formed in the bottom wall. The rubber plug may have a cylindrical configuration. The main-body portion of the rubber plug may have an outer protrusion that elastically contacts the inner surface of the second hole. The main-body portion of the rubber plug may have an inner protrusion that elastically contacts the outer surface of the electric wire. The inner housing may have a plurality of terminal accommodation chambers while the bottom wall of the outer housing may have a plurality of holes that receive therein a plurality of the extended portions. Further, the waterproof connector may have a spacer that retains the terminal within the terminal accommodation chamber between the inner housing and the outer housing.

According to this construction, the electric wire contacted with the extended portion of the rubber plug extended into the hole of the outer housing. Therefore, impairment of the electric wire due to the vibrations, etc. is reliably prevented owing to the elasticity of the extended portion of the rubber plug. Also, even when water pools within the extended portion of the rubber plug and freezes, the expansion of its volume is absorbed owing to the elasticity of the extended portion. Therefore, impairment of the outer housing is reliably prevented with the result that the reliability of the waterproofing of the connector is enhanced.

The waterproof connector according a second aspect of the present invention is one wherein in the first aspect of waterproof connector the rubber plug has an engaging portion that is engaged with the outer housing.

The engaging portion may be engaged with the bottom wall.

According to this construction, the engaging portion of the rubber plug is engaged with the outer housing. Therefore, when the electric wire is inserted from outside the outer housing by way of the interior of the rubber plug, the rubber plug is prevented from being drawn off from the concavity portion of the outer housing. Accordingly, reliability of the waterproofing obtained with the use of the rubber plug is further enhanced.

DESCRIPTION OF THE PREFERRED EMBODIMENTS

A first embodiment of the present invention will now be explained with reference to the drawings.

Figure 1:
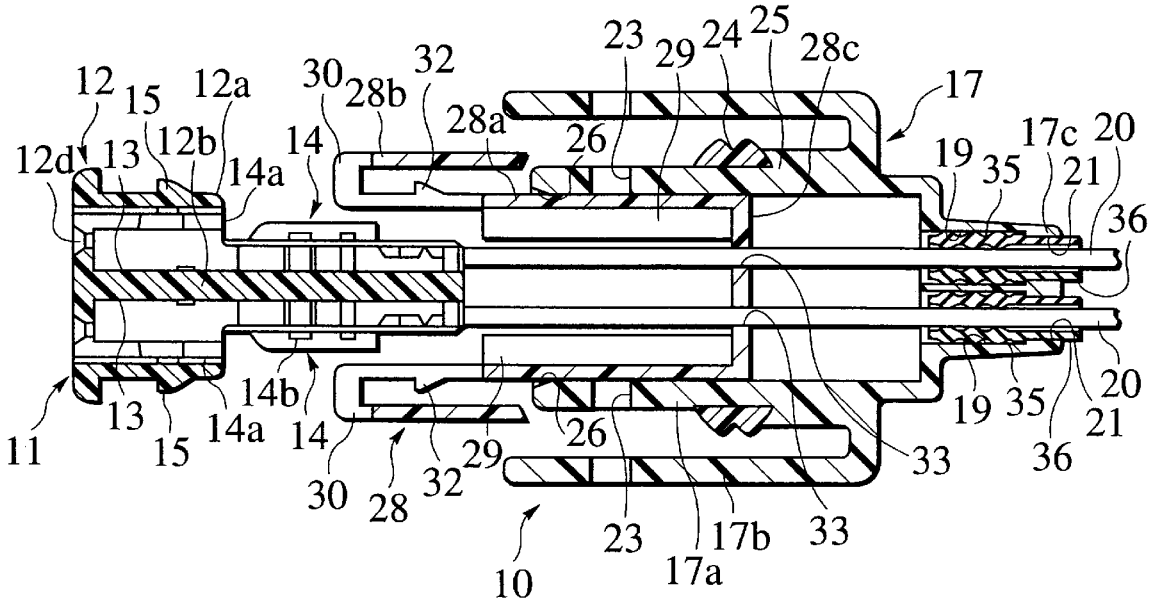
FIG. 1 is a sectional view illustrating a state, before the assembling, of a waterproof connector according to a first embodiment of the present invention.
Figure 2:
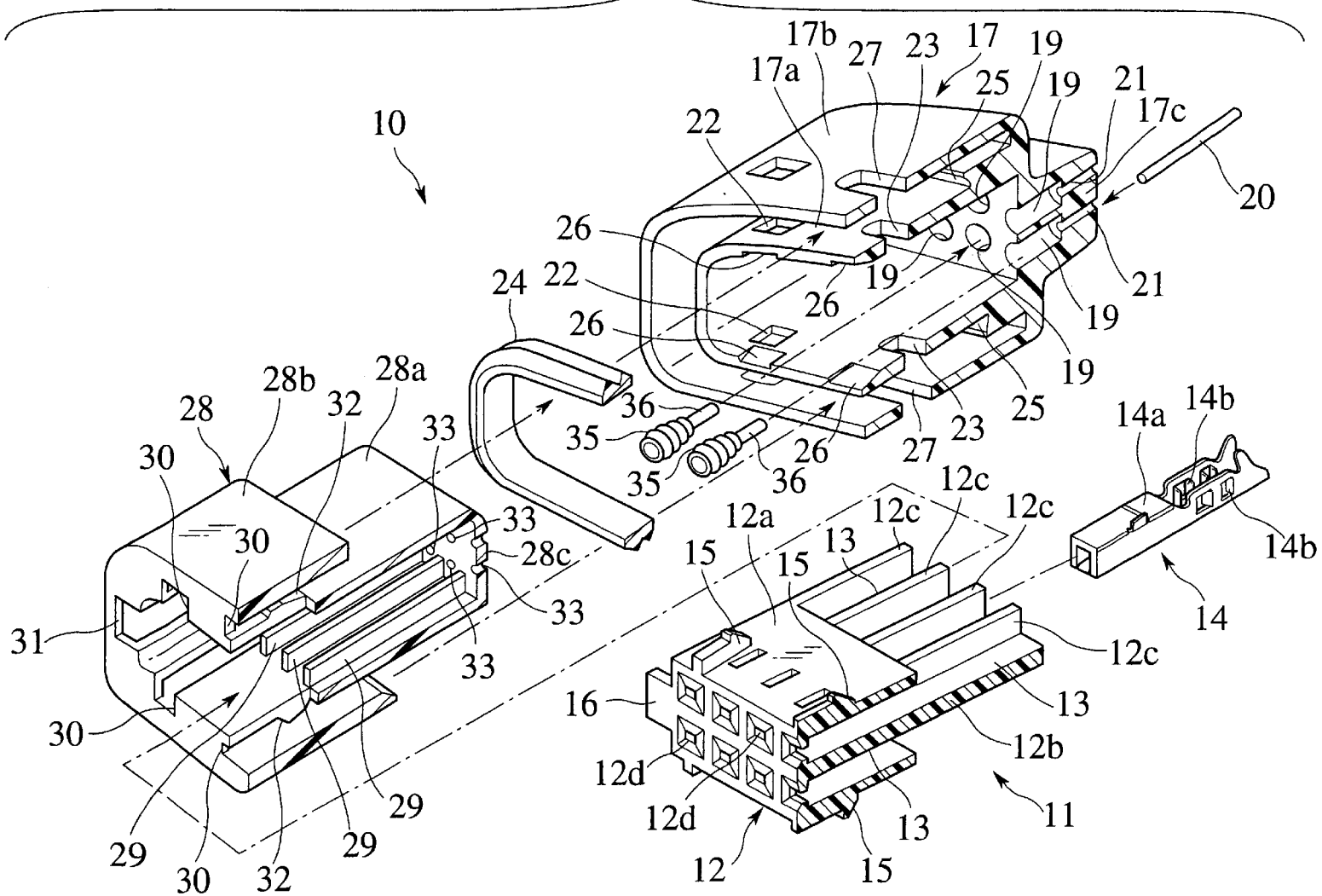
FIG. 2 is a perspective view illustrating, partly in section, the waterproof connector of FIG. 1.

As illustrated in FIGS. 1 and 2, a waterproof connector 10 has a connector housing 11, a waterproof packing 24, a synthetic resin-made spacer 28, and a rubber plug 35. The connector housing 11 has a synthetic resin-made inner housing 12 and a synthetic resin-made outer housing 17.

Within the inner housing 12 there are formed a plurality of terminal accommodation chambers 13. The inner housing 12 is fitted into the outer housing 17. The spacer 28 is disposed between the housings 12 and 17 and retains a female terminal (terminal) 14 that has been accommodated within the terminal accommodation chamber 13.

The inner housing 12 has a box portion 12*a* equipped with a rear portion that is opened upward and downward. The terminal accommodation chamber 13 is defined by a central horizontal wall 12*b* and upper and lower vertical side walls 12*c* concurrently serving as partitioning walls. The female terminal 14 is accommodated within a corresponding one of the terminal accommodation chambers 13. On both sides and a center of each of upper and lower surfaces of the box portion 12*a* there are integrally projectingly formed engaging/retaining pawls 15, respectively. On the front end of each of side walls situated at both side ends of the box portion 12*a* there are integrally projectingly formed flange portions 16. In a front wall of the box portion 12*a* there are formed correspondingly to the terminal accommodation chambers 13 rectangular insertion holes 12*d* through which male terminals of a mating side connector not illustrated are inserted. The female terminal 14 has a pair of pressure contact blades 14*b* and 14*b*.

The outer housing 17 has a substantially square-hollow-cylindrical inner wall 17*a*, a substantially square-hollow-cylindrical outer wall 17*b* that has been situated on the outer side of the inner wall 17*b*, and a bottom wall 17*c* connecting rear portions of the inner and outer walls 17*a*, 17*b* to each other. The outer housing 17 accordingly has as a whole a configuration like a double-walled box, a front surface side of that is opened. A central part of the bottom wall 17*c* is thicker-walled than a peripheral edge thereof. At the central part of the bottom wall 17*c* there are formed a plurality of sets of holes, each set of holes consisting of a first hole 21 and a second hole 19, that oppose the terminal accommodation chambers 13, respectively. The second hole 19 has a circular cross section and is open into the outer housing 17. Into the second hole 19 there is accommodated by forced insertion, etc. a main-body portion 35*d* of a rubber plug 35 as later described. The first hole 21 has a circular cross section, the diameter of that is smaller than that of the second hole 19, and this first hole 21 communicates the second hole 19 and the exterior of the outer housing 17. Into the first hole 21 there is inserted an extended portion 36 of the rubber plug 35 as later described.

In both side ends of a front portion of each of upper and lower walls of the inner wall 17*a* of the outer housing 17 there are formed rectangular engaging/retaining holes 22 that are engaged with their corresponding engaging/retaining pawls 15 of the inner housing 12. In a central portion of the front portion of each of the upper and lower walls of the inner wall 17*a* there is formed a rectangular engaging/retaining hole 23 that is engaged with its corresponding engaging pawl 15 of the inner housing 12. On an outer surface of the inner wall 17*a* of the outer housing 17 there is formed a V-shaped packing receiver portion 25 that receives an annular, rubber-made waterproof packing 24. In a front edge on an inner surface side of the inner wall 17*a* of the outer housing 17 there are formed tapered surfaces 26 that oppose the engaging/retaining holes 22 and 23. In a front portion of each of the upper and lower walls of the outer wall 17*b* of the outer housing 17 there is formed an engaging/retaining hole 27 that is engaged with its corresponding flexible engaging/retaining arm of the mating side connector not illustrated.

The spacer 28 has a substantially square-hollow-cylindrical trunk portion 28*a* that is fitted into the inner surface side of the inner wall 17*a* of the outer housing 17. The spacer also has a substantially square-hollow-cylindrical flange portion 28*b* that is integrally formed such that it is bent and curved rearward from a front end of the trunk portion 28*a* and that is fitted onto the outer surface side of the inner wall 17*a* of the outer housing 17. The spacer 28 further has a bottom wall 28*c* of the trunk portion 28*a*. The spacer 28 therefore has a configuration like a box, a front surface side of that is open, as a whole.

The box portion 12*a* of the inner housing 12 is fitted into the interior of the trunk portion 28*a* of the spacer 28. Rib-like protrusions 29 for preventing the draw-off of the female terminal 14 integrally protrude from the inner surface of each of upper and lower walls of the trunk portion 28*a* of the spacer 28. The protrusions 29 are engaged with a rear end edge of the box portion 12*a* of the inner housing 12. Each of them is also engaged with a rear end edge of the box portion 14*a* of its corresponding female terminal 14 that is accommodated within its corresponding terminal accommodation chamber 13.

In a connecting portion of the trunk portion 28*a* and the flange portion 28*b* of the spacer 28 there are formed notches 30 and 31 that correspond to the engaging/retaining pawls 15 and the flange portions 16 of the inner housing 12. Between the upper and lower walls of the trunk portion 28*a* there protrude engaging/retaining pawls 32 that are engaged with the engaging/retaining holes 23 of the outer housing 17. A forward end of the flange portion 28*b*, when the spacer 28 has been fitted into the outer housing 17, retains the packing 24 engaged with and received by the packing receiver portion 25 of the inner wall 17*a* of the outer housing 17.

In the bottom wall 28*c* of the spacer 28 there are formed electric-wire insertion through-holes 33 that oppose their corresponding second holes 19 of the outer housing 17. When the spacer 28 has been fitted into the outer housing 17, the bottom wall 28*c* retains the rubber plugs 35 within the bottom wall 17*c* of the outer housing 17. When inserted through their corresponding rubber plugs 35 and their electric-wire insertion through-holes 33 of the spacer 28, the electric wires 20 are each connected between a pair of the pressure-contact blades 14*b* and 14*b* of their corresponding female terminal 14. In this case, as seen, the female terminal 14 is accommodated within its corresponding terminal accommodation chamber 13 of the inner housing 12. The terminal accommodation chamber 13 and its corresponding electric wire 20 are sealed by its corresponding rubber plug 35 and the packing 24.

Figure 3:
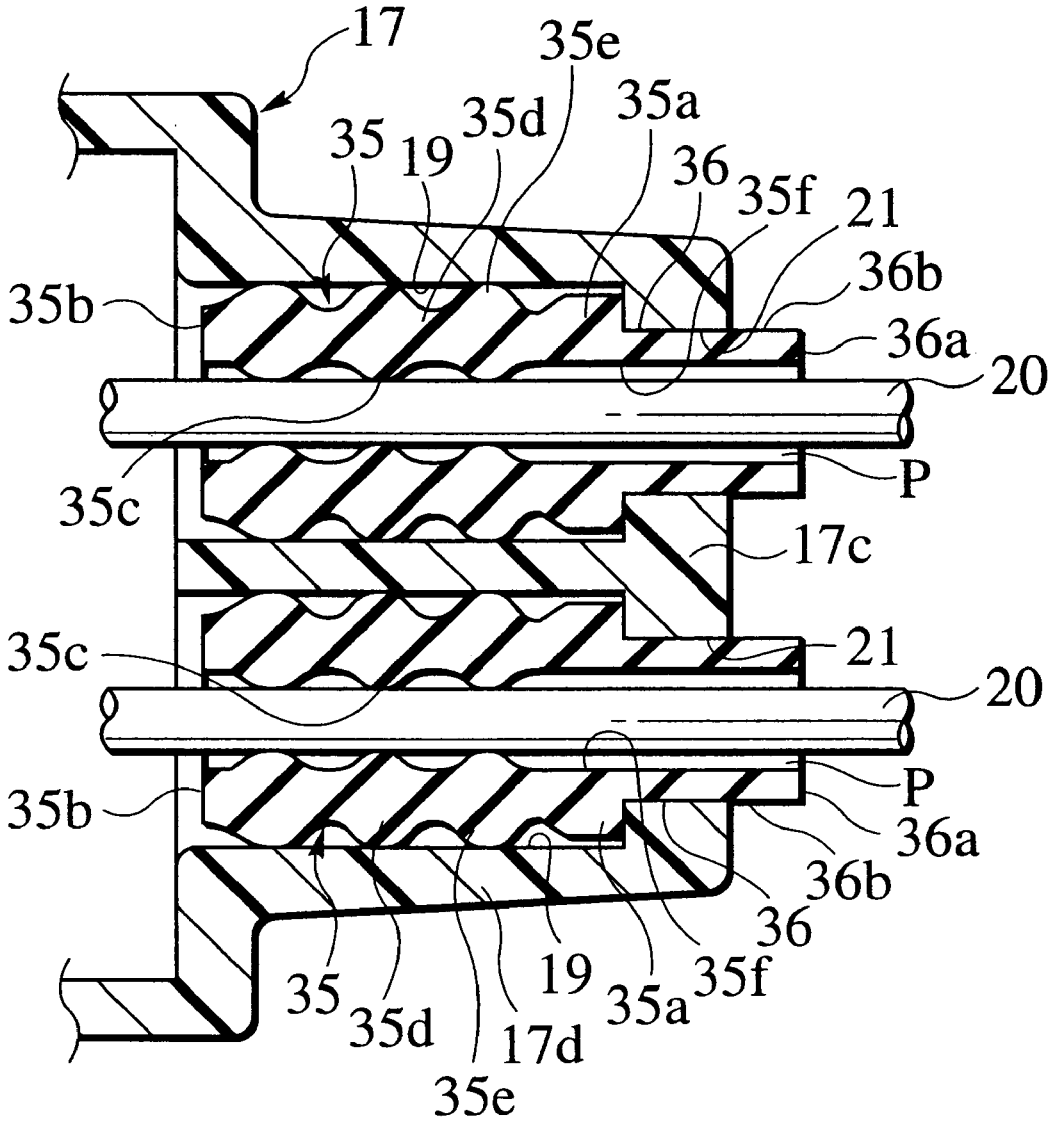
FIG. 3 is an enlarged sectional view illustrating a main part of FIG. 1.

As illustrated in FIG. 3, the rubber plug 35 has a cylindrical configuration as a whole, and includes the main-body portion 35*d* and the extended portion 36. The extended portion 36 is integrally extended from one end 35*a* of the main-body portion 35*d*. Within the rubber plug 35 there is formed a through hole 35*f* from one end 36*a* of the extended portion 36 to the other end 35*b* of the main-body portion 35*d*. The main-body portion 35*d* has a substantially circular-cylindrical configuration that is equipped with outer protrusions 35*e* and inner protrusions 35*c* that are situated on its outer-peripheral surface and its inner-peripheral surface, respectively. The outer protrusions 35*e* are elastically contact the inner-peripheral surface of the second hole 19 while the inner protrusions 35*c* elastically contact the outer-peripheral surface of the electric wire 20. By the outer protrusions 35*e* and the inner protrusions 35*c*, the occurrence of a clearance between the inner-peripheral surface of the second hole 19 and the outer-peripheral surface of the electric wire 20 is prevented. A waterproofing effect is thereby obtained.

In correspondence with the fact that the inside diameter of the first hole 21 is smaller than the inside diameter of the second hole 19, the outer diameter of the extended portion 36 is smaller than the outside diameter of the main-body portion 35*d*. The one end 35*a* of the main-body portion 35*d* being contacted with the bottom surface of the second hole 19, the rubber plug 35 is positioned.

When assembling the waterproof connector 10, it is done to insert the rubber plug 35 from within the outer housing 17 into the second hole 19. And then it is done to insert the packing 24 against the packing receiver portion 25 of the outer housing 17. The rubber plug 35 is first inserted into the second hole 19 from its extended portion 36. And this extended portion is inserted into the first hole 21 by passing through the second hole 19.

Next, the trunk portion 28*a* of the spacer 28 is fitted into the inner wall 17*a* of the outer housing 17 to thereby bring the engaging/retaining pawl 32 of the spacer 28 into engagement with the engaging/retaining hole 23 of the outer housing 17. When the engaging/retaining hole 23 and the engaging/retaining pawl 32 have been engaged with each other, the bottom wall 17*c* of the outer housing 17 stops the draw-off of the rubber plug 35. Simultaneously, the forward end of the flange portion 28*b* of the spacer 28 stops the draw-off of the packing 24.

Next, the electric wire 20 is inserted into the outer housing 17 from outside the same by way of the through hole 35*f* of its corresponding rubber plug 35. Then, the electric wire 20 is forced into between a pair of the pressure-contact blades 14*b* and 14*b* of its corresponding female terminal 14 within its corresponding terminal accommodation chamber 13.

Next, the inner housing 12 is fitted into the trunk portion 28*a* of the spacer to thereby bring the engaging/retaining pawl 15 of the inner housing 12 into engagement and retention with the engaging/retaining hole 23 of the outer housing 17. As a result of this, the assembling of the waterproof connector 10 completes. In this condition, the rear end edge of the box portion 12*a* of the inner housing 12 and the rear end edges of the box portions 14*a* of the female terminal 14 within the terminal accommodation chambers 13 are respectively locked by the protrusions 29 of the spacer 28. Since these protrusions 29 do not deform to the outer side, the draw-off of the female terminals 14 from the terminal accommodation chambers 13 is prevented. Further, since the spacer 28 retains both of the female terminal 14 and the rubber plug 35, the use of single-purpose parts for preventing the draw-off of the rubber plugs 35 is unnecessary. Further, the spacer 28 is doubly locked by the engagement between the engaging/retaining pawl 32 and its corresponding engaging/retaining hole 23 and by the engagement between the engaging/retaining pawl 15 and its corresponding engaging/retaining hole 23. Therefore, the draw-off of the rubber plug 35 and the packing 24 is reliably prevented.

In the above-described waterproof connector 10, the extended portion 36 of the rubber plug 35 is disposed between the inner-peripheral surface of the first hole 21 and the electric wire 20. Therefore, no direct contact of the electric wire 20 with the inner surface of the first hole 21 occurs. Accordingly, the wear and impact due to the vibrations applied to the electric wire 20 are reliably absorbed by the elasticity of the extended portion 36 to prevent the impairment of the electric wire reliably.

Even when water is gathered into and pooled within the extended portion 36 of the rubber plug 35 (an open end P of the through hole 35*c*), the elasticity of the extended portion 36 reliably absorbs the expansion of its volume. This reliably prevents the impairment of a seal wall composed of the bottom wall 17*c* and a peripheral wall 17*d* of the second hole 19. As a result of this, the reliability on the waterproofing attained with the rubber plugs 35 is enhanced.

Figure 4:
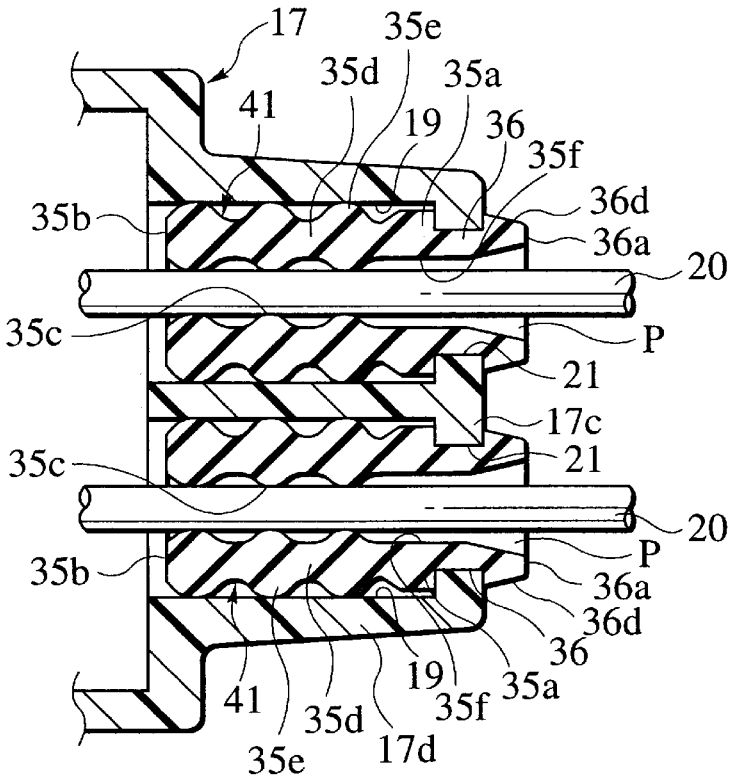
FIG. 4 is an enlarged sectional view illustrating a main part of a waterproof connector according to a second embodiment of the present invention.

FIG. 4 is an enlarged sectional view illustrating a seal portion for making a seal based on the use of waterproof rubber plugs 41 according to a second embodiment of the present invention. The extended portion 36 of the rubber plug 41 is extended up to outside the first hole 21 of the outer housing 17 as in the case of the first embodiment. Hook-shaped and annular engaging/retaining protrusions (engaging portions) 36*d* that are engaged with the outer surface of the bottom wall 17*c* integrally protrude from one end 36*a* of the extended portion 36. It is to be noted that since other constructions are the same as those in the first embodiment, the identical portions are denoted by like reference numerals and explanations thereof are omitted.

According to this embodiment, in addition to the function and effect the same as those attainable with the first embodiment, the following function and effect are obtained. Namely, when the electric wire 20 is inserted from outside the outer housing 17 via the through hole 35*f* of the rubber plug 41, the draw-off of the rubber plug 41 from within the second hole 19 is prevented by the engagement between the outer surface of the bottom wall 17*c* and the engaging/retaining protrusion 36*d*. This further enhances the reliability on the waterproofness attainable with the rubber plugs 41.

Figure 5:
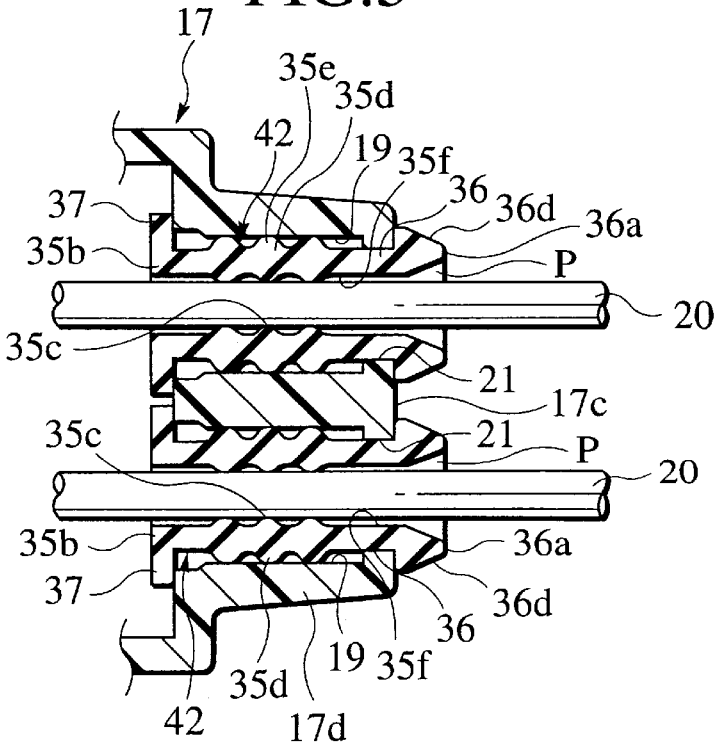
FIG. 5 is an enlarged sectional view illustrating a main part of a waterproof connector according to a third embodiment of the present invention.

FIG. 5 is an enlarged sectional view illustrating the seal portion for making a seal based on the use of waterproof rubber plugs 42 according to a third embodiment of the present invention. The rubber plug 42 has, in addition to the engaging/retaining protrusion 36*d* of the extended portion 36 similar to that of the second embodiment, a hook-shaped annular engaging/retaining protrusion (engaging portion) 37 that is situated on the other end 35*b* of the main-body portion 35*d*. The engaging/retaining protrusion 37 is engaged with the inner surface of the bottom wall 17*c* of the outer housing 17. It is to be noted that since other constructions are the same as those in the second embodiment, the identical portions are denoted by like reference numerals and explanations thereof are omitted.

According to this embodiment, the draw-off of the rubber plug 42 is more reliably prevented than in the case of the second embodiment, whereby the reliability on the waterproofing is further enhanced.

Incidentally, although in each of the respective embodiments an explanation has been given of the case of performing pressure-contact connection of the electric wire to its corresponding pressure-contact terminal, the terminal is not limited to the pressure-contact terminal. Namely, even in a case where performing pressure-bond connection of the electric wire to its corresponding pressure-bond terminal, each of the respective said embodiments can of course be also applied to this terminal as well.

What is claimed is:

1. A waterproof connector comprising:

an inner housing having a terminal accommodation chamber, a terminal that is accommodated within the terminal accommodation chamber being connected to an electric wire;

an outer housing having an opening and a bottom wall, whereby, when the inner housing is inserted from the opening into the outer housing and both are fitted together, the bottom wall opposes the terminal accommodation chamber, the outer housing having a hole and a concavity portion, the hole being formed in the bottom wall and opening toward outside the outer housing, and the concavity portion communicating with the hole and with an interior of the outer housing; and a rubber plug having a main-body portion configured to fit into the concavity portion, a cylindrical extended portion configured to fit into the hole, and a through hole passing through the interior of the main-body portion and that of the extended portion, whereby the main-body portion is inserted into the concavity portion while the extended portion is inserted into the concavity portion while the extended portion is inserted into the hole, the through hole providing communication between the interior of the outer housing and an exterior of the same, the electric wire passing through the through hole and being then extended into the outer housing and connected to the terminal.

2. A waterproof connector according to claim 1, wherein the extended portion extends outside the outer housing.

3. A waterproof connector according to claim 1, wherein the rubber plug has an engaging portion engaging the outer housing.

4. A waterproof connector according to claim 3, wherein the engaging portion engages the bottom wall.

5. A waterproof connector according to claim 1, wherein the concavity portion includes a second hole formed in the bottom wall.

6. A waterproof connector according to claim 5, wherein the rubber plug has a cylindrical configuration.

7. A waterproof connector according to claim 6, wherein the main-body portion of the rubber plug has an outer protrusion that elastically contacts an inner surface of the second hole.

8. A waterproof connector according to claim 6, wherein the main-body portion of the rubber plug has an inner protrusion that elastically contacts an outer surface of the electric wire.

9. A waterproof connector according to claim 1, wherein the inner housing has a plurality of terminal accommodation chambers; and the bottom wall of the outer housing has a plurality of holes, each hole being configured to receive therein an extended portion of a corresponding rubber plug.

10. A waterproof connector according to claim 1, further comprising:

a spacer configured to retain the terminal within the terminal accommodation chamber between the inner housing and the outer housing.

11. A rubber plug for use in a waterproof connector, the waterproof connector having an inner housing having a terminal accommodation chamber and an outer housing having an opening and a bottom wall, a terminal that is accommodated within the terminal accommodation chamber being connected to an electric wire, whereby, when the inner housing is inserted from the opening into the outer housing and both are fitted together, the bottom wall opposes the terminal accommodation chamber, the outer housing having a hole that is formed in the bottom wall and that opens toward outside the outer housing, and a concavity portion that communicates with the hole and with an interior of the outer housing, the rubber plug comprising:

a main-body portion configured to be inserted into the concavity portion;

an extended portion that is integrally formed with the main-body portion and configured to be inserted into the hole; and a through hole passing through the main-body portion and the extended portion to thereby provide communication between the interior and an exterior of the outer housing, the electric wire passing through the through hole and extending into the outer housing and connecting to the terminal.

12. A rubber plug according to claim 11, wherein the extended portion extends outside the outer housing.

13. A rubber plug according to claim 11, further comprising: an engaging portion engaging the outer housing.

14. A rubber plug according to claim 13, wherein the engaging portion is integrally formed with the extended portion and engages the bottom wall.

15. A rubber plug according to claim 11, wherein the main-body portion has a cylindrical configuration.

16. A rubber plug according to claim 15, wherein the main-body portion has an outer protrusion that elastically contacts an inner surface of the concavity portion.

17. A rubber plug according to claim 15, wherein the main-body portion has an inner protrusion that elastically contacts an outer surface of the electric wire.

18. A waterproof connector according to claim 1, wherein the concavity portion includes a second hole, and wherein the diameter of the second hole is larger than a diameter of the first hole.

19. A waterproof connector comprising:

an inner housing having a terminal accommodation chamber, a terminal that is accommodated within the terminal accommodation chamber being connected to an electric wire;

an outer housing having an opening and a bottom wall, whereby, when the inner housing is inserted from the opening into the outer housing and both are fitted together, the bottom wall opposes the terminal accommodation chamber, the outer housing having a first hole and a second hole, the first hole having a smaller diameter than the second hole, the first hole being formed in the bottom wall and opening toward outside the outer housing, and the second hole communicating with the first hole and an interior of the outer housing; and a rubber plug having a main-body portion configured to fit into the second hole, a cylindrical extended portion configured to fit into the first hole, and a through hole passing through the interior of the main-body portion and that of the extended portion, whereby the main-body portion is inserted into the second hole while the extended portion is inserted into the first hole, the through hole providing communication between the interior of the outer housing and an exterior of the same, the electric wire passing through the through hole and being then extended into the outer housing and connected to the terminal.

20. A waterproof connector according to claim 19, wherein the extended portion of the plug extends outside the outer housing.

* * * * *

UNITED STATES PATENT AND TRADEMARK OFFICE

CERTIFICATE OF CORRECTION

PATENT NO. : 6,254,431 B1
DATED : July 3, 2001
INVENTOR(S) : Takao Murakami et al.

It is certified that error appears in the above-identified patent and that said Letters Patent is hereby corrected as shown below:

Title page,
Item [54], in the title, "WATERPROOF CONNECTOR" should read
-- COUPLED HOUSING CONNECTOR WITH WATERPROOF PLUG --.

Signed and Sealed this

Twenty-fifth Day of June, 2002

*Attest:*

*Attesting Officer*

JAMES E. ROGAN
*Director of the United States Patent and Trademark Office*